US010652962B1

(12) United States Patent
Qiu

(10) Patent No.: US 10,652,962 B1
(45) Date of Patent: May 12, 2020

(54) DIM-TO-WARM LED CIRCUIT

(71) Applicant: Lumileds LLC, San Jose, CA (US)

(72) Inventor: Yifeng Qiu, San Jose, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/454,730

(22) Filed: Jun. 27, 2019

(51) Int. Cl.
*H05B 37/02* (2006.01)
*H05B 33/08* (2020.01)

(52) U.S. Cl.
CPC ..... *H05B 33/0821* (2013.01); *H05B 33/086* (2013.01); *H05B 33/0845* (2013.01); *H05B 33/0815* (2013.01); *H05B 33/0857* (2013.01)

(58) Field of Classification Search
CPC ..... H05B 33/0815; H05B 33/0857; H05B 33/086
USPC ..... 315/185 R, 291, 294, 299
See application file for complete search history.

(56) References Cited

U.S. PATENT DOCUMENTS

| | | | | |
|---|---|---|---|---|
| 8,729,812 | B2 * | 5/2014 | Kuwu | H05B 33/0863 315/219 |
| 9,131,581 | B1 * | 9/2015 | Hsia | H05B 33/0815 |
| 9,801,250 | B1 | 10/2017 | Halliwell | |
| 10,517,156 | B1 | 12/2019 | Qiu et al. | |
| 2010/0072903 | A1 * | 3/2010 | Blaut | H05B 33/0863 315/185 R |
| 2010/0079088 | A1 | 4/2010 | Lipcsei et al. | |
| 2010/0109564 | A1 * | 5/2010 | Shin | H05B 33/0857 315/294 |
| 2011/0115407 | A1 * | 5/2011 | Wibben | H05B 33/0815 315/294 |
| 2013/0119872 | A1 | 5/2013 | Chobot | |
| 2014/0333216 | A1 | 11/2014 | Zhang et al. | |
| 2017/0127489 | A1 | 5/2017 | Zulim et al. | |
| 2017/0245338 | A1 | 8/2017 | Turunen | |
| 2017/0374718 | A1 | 12/2017 | Fang et al. | |

(Continued)

FOREIGN PATENT DOCUMENTS

| | | |
|---|---|---|
| EP | 3247174 | 11/2017 |

OTHER PUBLICATIONS

"U.S. Appl. No. 16/403,265, Notice of Allowance dated Sep. 27, 2019", 10 pgs.

(Continued)

*Primary Examiner* — Thuy V Tran
(74) *Attorney, Agent, or Firm* — Schwegman Lundberg & Woessner, P.A.

(57) ABSTRACT

Various embodiments include apparatuses and methods enabling a dim-to-warm circuit operation of an LED multi-colored array. In one example, an apparatus includes a hybrid driving-circuit coupled to the LED array and to a single control-device to receive an indication of a luminous flux desired from the LED array. A color temperature for the LED array is determined based on the desired luminous flux of the LED array. In various embodiments, the hybrid driving-circuit includes an analog current-division circuit to produce current for at least two LED current-driving sources and a multiplexer array coupled between the analog current-division circuit and the LED to provide periodically, for a predetermined amount of time, current from at least one of the at least two LED current-driving sources to at least two colors of the LED array. Other apparatuses and methods are described.

20 Claims, 9 Drawing Sheets

(56) References Cited

U.S. PATENT DOCUMENTS

| | | | |
|---|---|---|---|
| 2018/0146527 | A1 | 5/2018 | Yadav et al. |
| 2019/0116641 | A1 | 4/2019 | Wilson et al. |

OTHER PUBLICATIONS

"U.S. Appl. No. 16/258,193, Notice of Allowance dated Jun. 18, 2019", 9 pgs.
"European Application Serial No. 19205102.7, extended European Search Report dated Dec. 12, 2019", 7 pgs.
"European Application Serial No. 19204908.8, extended European Search Report dated Apr. 8, 2020", 9 pgs.

* cited by examiner

DIM-TO-WARM LED CIRCUIT

TECHNICAL FIELD

The subject matter disclosed herein relates to color tuning of one or more light-emitting diode arrays (LEDs) that comprise a lamp operating substantially in the visible portion of the electromagnetic spectrum. More specifically, the disclosed subject matter relates to a technique to enable a single color-tuning device (e.g., a dimmer) controls a dim-to-warm color-tuning apparatus in which a color temperature of the LEDs decreases as the LEDs are dimmed in intensity.

BACKGROUND

Light-emitting diodes (LEDs) are commonly used in various lighting operations. The color appearance of an object is determined, in part, by the spectral power density (SPD) of light illuminating the object. For humans viewing an object, the SPD is the relative intensity for various wavelengths within the visible light spectrum. However, other factors also affect color appearance. Also, both a correlated color temperature (CCT) of the LED, and a distance of the temperature of the LED on the CCT from a black-body line (BBL, also known as a black-body locus or a Planckian locus), can affect a human's perception of an object. In particular there is a large market demand for LED lighting solutions, such as in retail and hospitality lighting applications, where a color temperature of the LEDs can be controlled. Specifically, there is an increasing market demand for dim-to-warm lights for home and office installations. Contemporaneous lighting systems have attempted to satisfy this dim-to-warm LED mark by using two control devices: one for light output (e.g., luminous flux), and a separate device for CCT control. However, having two devices is costly to install. It would be ideal to have the LED light change its color temperature in relation to an amplitude of the incoming current while using only a single control-device.

The information described in this section is provided to offer the skilled artisan a context for the following disclosed subject matter and should not be considered as admitted prior art.

DETAILED DESCRIPTION

Figure 1:
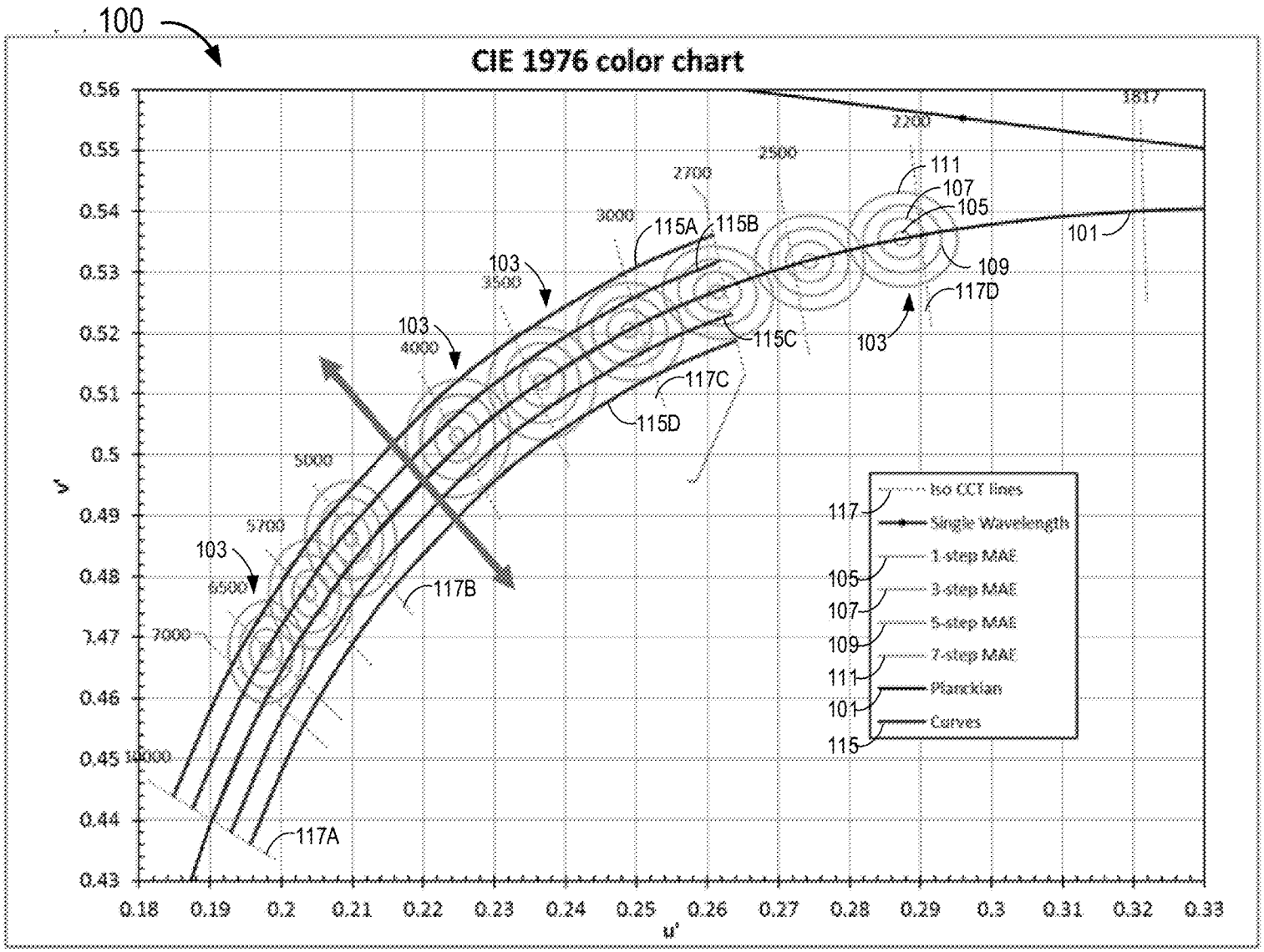
FIG. 1 shows a portion of an International Commission on Illumination (CIE) color chart, including a black body line (BBL)

The disclosed subject matter will now be described in detail with reference to a few general and specific embodiments as illustrated in various ones of the accompanying drawings. In the following description, numerous specific details are set forth in order to provide a thorough understanding of the disclosed subject matter. It will be apparent, however, to one skilled in the art, that the disclosed subject matter may be practiced without some or all of these specific details. In other instances, well-known process steps or structures have not been described in detail so as not to obscure the disclosed subject matter.

Examples of different light illumination systems and/or light emitting diode implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer generally to like elements throughout.

It will be understood that, although the terms first, second, third, etc. may be used herein to describe various elements. However, these elements should not be limited by these terms. These terms may be used to distinguish one element from another. For example, a first element may be termed a second element and a second element may be termed a first element without departing from the scope of the disclosed subject matter. As used herein, the term "and/or" may include any and all combinations of one or more of the associated listed items.

It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper," "lower," "horizontal," or "vertical" may be used herein to describe a relationship of one element, zone, or region relative to another element, zone, or region as illustrated in the figures. It will be understood that these terms are intended to encompass different orientations of the device in addition to an orientation depicted in the figures. Further, whether the LEDs, LED arrays, electrical components and/ or electronic components are housed on one, two, or more electronics boards may also depend on design constraints and/or a specific application.

Semiconductor-based light-emitting devices or optical power-emitting-devices, such as devices that emit ultraviolet (UV) or infrared (IR) optical power, are among the most efficient light sources currently available. These devices may include light emitting diodes, resonant-cavity light emitting diodes, vertical-cavity laser diodes, edge-emitting lasers, or the like (simply referred to herein as LEDs). Due to their compact size and low power requirements, LEDs may be attractive candidates for many different applications. For example, they may be used as light sources (e.g., flash lights and camera flashes) for hand-held battery-powered devices, such as cameras and cellular phones. LEDs may also be used, for example, for automotive lighting, heads-up display (HUD) lighting, horticultural lighting, street lighting, a torch for video, general illumination (e.g., home, shop, office and studio lighting, theater/stage lighting, and architectural lighting), augmented reality (AR) lighting, virtual reality (VR) lighting, as back lights for displays, and IR spectroscopy. A single LED may provide light that is less bright than an incandescent light source, and, therefore, multi-junction devices or arrays of LEDs (such as monolithic LED arrays, micro LED arrays, etc.) may be used for applications where enhanced brightness is desired or required.

In various environments where LED-based lamps (or related illumination devices) are used to illuminate objects as well as for general lighting, it may be desirable to control a temperature of the LED-based lamps (or a single lamp) in relationship to a relative brightness (e.g., luminous flux) of the lamps. For example, an end-user may desire that the lamps decrease in color temperature as the lamps are dimmed. Such environments may include, for example, retail locations as well as hospitality locations such as restaurants and the like. In addition to the CCT, another lamp metric is the color-rendering index (CRI) of the lamp. The CRI is defined by the International Commission on Illumination (CIE) and provides a quantitative measure of an ability of any light source (including LEDs) to accurately represent colors in various objects in comparison with an ideal, or natural-light source. The highest possible CRI value is 100. Another quantitative lamp metric is $D_{uv}$. The $D_{uv}$ is a metric defined in, for example, CIE 1960, to represent the distance of a color point to the BBL. It is a positive value if the color point is above the BBL and negative if below. Color points above the BBL appear greenish and those below the BBL appear pinkish. The disclosed subject matter provides an apparatus to control a color temperature relative to a brightness level of the lamp. As described herein, the color temperature is related to both CCT and $D_{uv}$ in color-tuning applications.

The disclosed subject matter is directed to a hybrid-driving scheme for driving various colors of LEDs including, for example, primary color (Red-Green-Blue or RGB) LEDs, or desaturated (pastel) RGB color LEDs, to make light of various color temperatures with a high color-rendering index (CRI) and high efficiency, specifically addressing color mixing using phosphor-converted color LEDs.

The forward voltage of direct color LEDs decreases with increasing dominant wavelength. These LEDS can be driven with, for example, multichannel DC-to-DC converters. Advanced phosphor-converted color LEDs, targeting high efficacy and CRI, have been created providing for new possibilities for correlated color temperature (CCT) tuning applications. Some of the advanced color LEDs have desaturated color points and can be mixed to achieve white colors with 90+ CRI over a wide CCT range. Other LEDs having 80+ CRI implementations, or even 70+ CRI implementations, may also be used with the disclosed subject matter. These possibilities use LED circuits that realize, and increase or maximize, this potential. At the same time, the control circuits described herein are compatible with single-channel constant-current drivers to facilitate market adoption.

As is known to a person of ordinary skill in the art, since light output of an LED is proportional to an amount of current used to drive the LED, dimming an LED can be achieved by, for example, reducing the forward current transferred to the LED. In addition to or instead of changing an amount of current used to drive each of a number of individual LEDs, a controller box (described in detail with reference to FIG. 6A, below) may rapidly switch selected ones of the LEDs between "on" and "off" states to achieve an appropriate level of dimming and color temperature for the selected lamp.

Generally, LED drive circuits are formed using either an analog-driver approach or a pulse-width modulation (PWM)-driver approach. In an analog driver, all colors are driven simultaneously. Each LED is driven independently by providing a different current for each LED. The analog driver results in a color shift and currently there is not a way to shift current three ways. Analog driving often results in certain colors of LEDs being driven into low current mode and other times, into very high current mode. Such a wide dynamic range imposes a challenge on sensing and control hardware.

In a PWM driver, each color is switched on, in sequence, at high speed. Each color is driven with the same current. The mixed color is controlled by changing the duty cycle of each color. That is, one color can be driven for twice as long as another color to add into the mixed color. As human vision is unable to perceive very fast changing colors, the light appears to have one single color.

For example, the first LED is driven with a current for a predetermined amount of time, then the second LED is driven with the same current for a predetermined amount of time, and then the third LED is driven with the current for a predetermined amount of time. Each of the three predetermined amounts of time may be the same amount of time or different amounts of time. The mixed color is therefore controlled by changing the duty cycle of each color. For example, if you have an RGB LED and desire a specific output, red may be driven for a portion of the cycle, green for a different portion of the cycle, and blue is driven for yet another portion of the cycle based on the perception of the human eye. Instead of driving the red LED at a lower current, it is driven at the same current for a shorter time. This example demonstrates the downside of PWM with the LEDs being poorly utilized, therefore leading to an inefficient use of power.

Another advantage of the disclosed subject matter over the prior art is that the desaturated RGB approach can create tunable light on and off the BBL while maintaining a high CRI. Various other prior art systems, in comparison, utilize a CCT approach where tunable color-points fall on a straight line between two primary colors of LEDs (e.g., R-G, R-B, or G-B).

FIG. 1 shows a portion of an International Commission on Illumination (CIE) color chart 100, including a black body line (BBL) 101 (also referred to as a Planckian locus) that forms a basis for understanding various embodiments of the subject matter disclosed herein. The BBL 101 shows the chromaticity coordinates for blackbody radiators of varying temperatures. It is generally agreed that, in most illumination situations, light sources should have chromaticity coordinates that lie on or near the BBL 101. Various mathematical procedures known in the art are used to determine the "closest" blackbody radiator. As noted above, this common lamp specification parameter is called the correlated color temperature (CCT). A useful and complementary way to further describe the chromaticity is provided by the $D_{uv}$ value, which is an indication of the degree to which a lamp's chromaticity coordinate lies above the BBL 101 (a positive $D_{uv}$ value) or below the BBL 101 (a negative $D_{uv}$ value).

The portion of the color chart is shown to include a number of isothermal lines 117. Even though each of these lines is not on the BBL 101, any color point on the isothermal line 117 has a constant CCT. For example, a first isothermal line 117A has a CCT of 10,000 K, a second isothermal line 117B has a CCT of 5,000 K, a third isothermal line 117C has a CCT of 3,000 K, and a fourth isothermal line 117D has a CCT of 2,200 K.

With continuing reference to FIG. 1, the CIE color chart 100 also shows a number of ellipses that represent a Macadam Ellipse (MAE) 103, which is centered on the BBL 101 and extends one step 105, three steps 107, five steps 109, or seven steps 111 in distance from the BBL 101. The MAE is based on psychometric studies and defines a region on the CIE chromaticity diagram that contains all colors which are indistinguishable, to a typical observer, from a color at the center of the ellipse. Therefore, each of the MAE steps 105 to 111 (one step to seven steps) are seen to a typical observer as being substantially the same color as a color at the center of a respective one of the MAEs 103. A series of curves, 115A, 115B, 115C, and 115D, represent substantially equal distances from the BBL 101 and are related to $D_{uv}$ values of, for example, +0.006, +0.003, 0, −0.003 and −0.006, respectively.

Figure 2A:
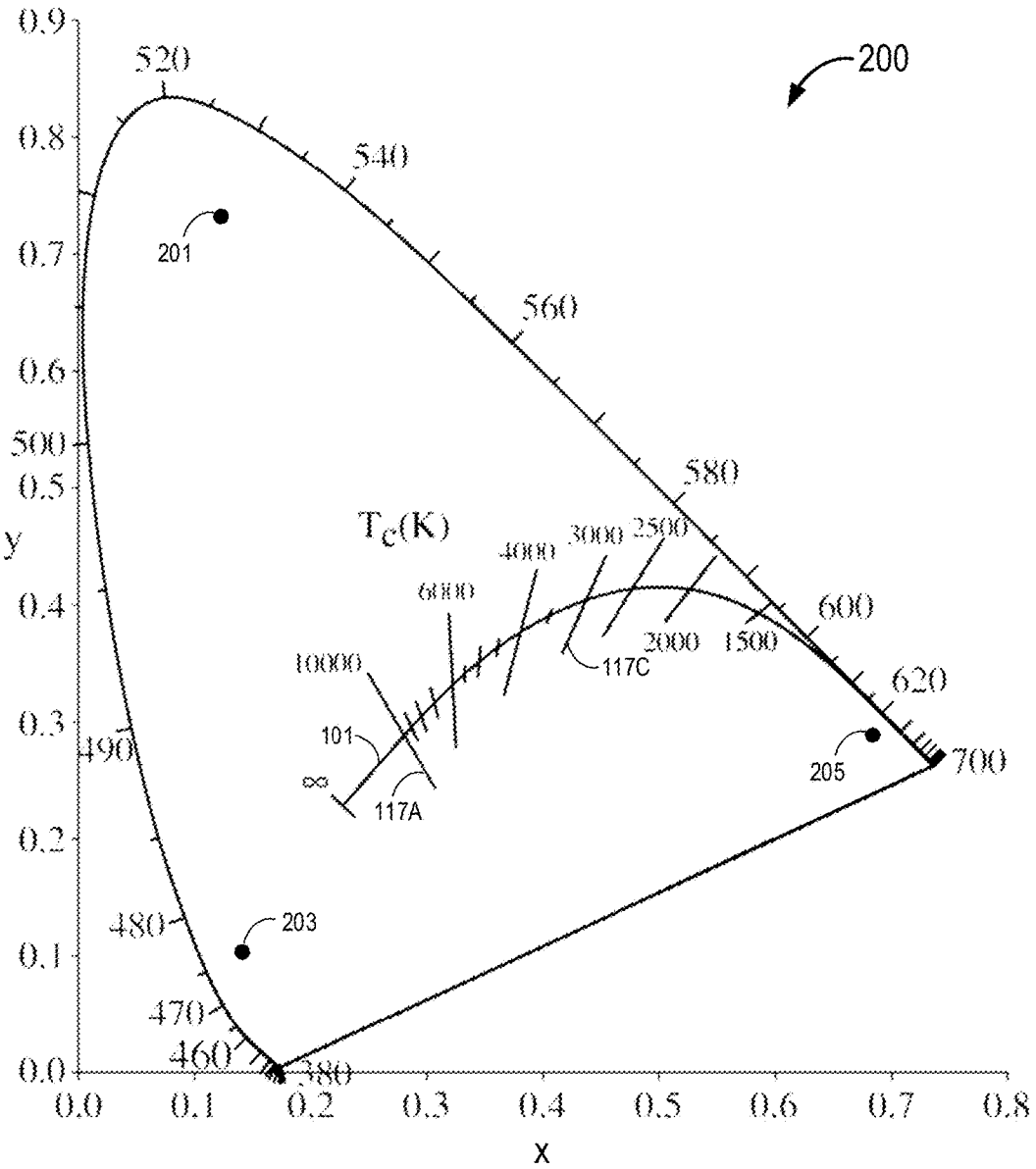
FIG. 2A shows a chromaticity diagram with approximate chromaticity coordinates of colors for typical red (R), green (G), and blue (B) LEDs, on the diagram, and including a BBL.

Referring now to FIG. 2A, and with continuing reference to FIG. 1, FIG. 2A shows a chromaticity diagram 200 with approximate chromaticity coordinates of colors for typical coordinate values (as noted on the x-y scale of the chromaticity diagram 200) for a red (R) LED at coordinate 205, a green (G) LED at coordinate 201, and a blue (B) LED at coordinate 203. FIG. 2A shows an example of the chromaticity diagram 200 for defining the wavelength spectrum of a visible light source, in accordance with some embodiments. The chromaticity diagram 200 of FIG. 2A is only one way of defining a wavelength spectrum of a visible light source; other suitable definitions are known in the art and can also be used with the various embodiments of the disclosed subject matter described herein.

A convenient way to specify a portion of the chromaticity diagram 200 is through a collection of equations in the x-y plane, where each equation has a locus of solutions that defines a line on the chromaticity diagram 200. The lines may intersect to specify a particular area, as described below in more detail with reference to FIG. 2B. As an alternative definition, the white light source can emit light that corresponds to light from a blackbody source operating at a given color temperature.

The chromaticity diagram 200 also shows the BBL 101 as described above with reference to FIG. 1. Each of the three LED coordinate locations 201, 203, 205 are the CCT coordinates for "fully-saturated" LEDs of the respective colors green, blue, and red. However, if a "white light" is created by combining certain proportions of the R, G, and B LEDs, the CRI of such a combination would be extremely low. Typically, in the environments described above, such as retail or hospitality settings, a CRI of about 90 or higher is desirable.

Figure 2B:
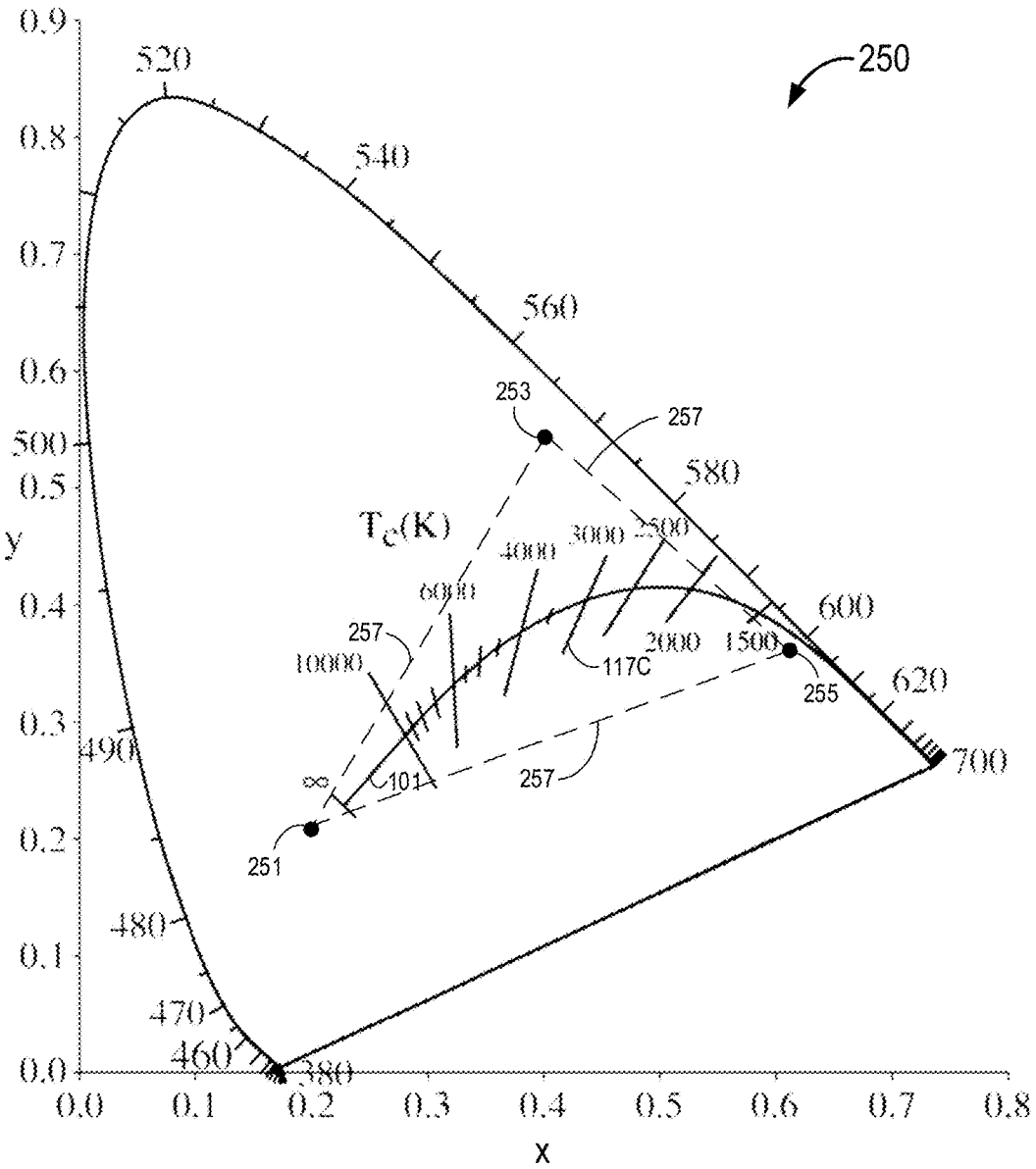
FIG. 2B shows a revised version of the chromaticity diagram of FIG. 2A, with approximate chromaticity coordinates for desaturated R, G, and B LEDs in proximity to the BBL, in accordance with various embodiments of the disclosed subject matter.

FIG. 2B shows a revised version of the chromaticity diagram 200 of FIG. 2A. However, the chromaticity diagram 250 of FIG. 2B shows approximate chromaticity coordinates for desaturated (pastel)R, G, and B LEDs in proximity to the BBL 101. Coordinate values (as noted on the x-y scale of the chromaticity diagram 250) are shown for a desaturated red (R) LED at coordinate 255, a desaturated green (G) LED at coordinate 253, and a desaturated blue (B) LED at coordinate 251. In various embodiments, a color temperature range of the desaturated R, G, and B LEDs may be in a range from about 1800 K to about 2500 K. In other embodiments, the desaturated R, G, and B LEDs may be in a color temperature range of about 2700 K to about 6500 K. As noted above, the color rendering index (CRI) of a light source does not indicate the apparent color of the light source; that information is given by the correlated color temperature (CCT). The CRI is therefore a quantitative measure of the ability of a light source to reveal the colors of various objects faithfully in comparison with an ideal or natural-light source.

In a specific exemplary embodiment, a triangle 257 formed between each of the coordinate values for the desaturated R, G, and B LEDs is also shown. The desaturated R, G, and B LEDs are formed (e.g., by a mixture of phosphors and/or a mixture of materials to form the LEDs as is known in the art) to have coordinate values in proximity to the BBL 101. Consequently, the coordinate locations of the respective desaturated R, G, and B LEDs, and as outlined by the triangle 257, has a CRI have approximately 90 or greater. Therefore, the selection of a correlated color temperature (CCT) may be selected in the color-tuning application described herein such that all combinations of CCT selected all result in the lamp having a CRI of 90 or greater. Each of the desaturated R, G, and B LEDs may comprise a single LED or an array (or group) of LEDs, with each LED within the array or group having a desaturated color the same as or similar to the other LEDs within the array or group. A combination of the one or more desaturated R, G, and B LEDs comprises a lamp.

Figure 3:
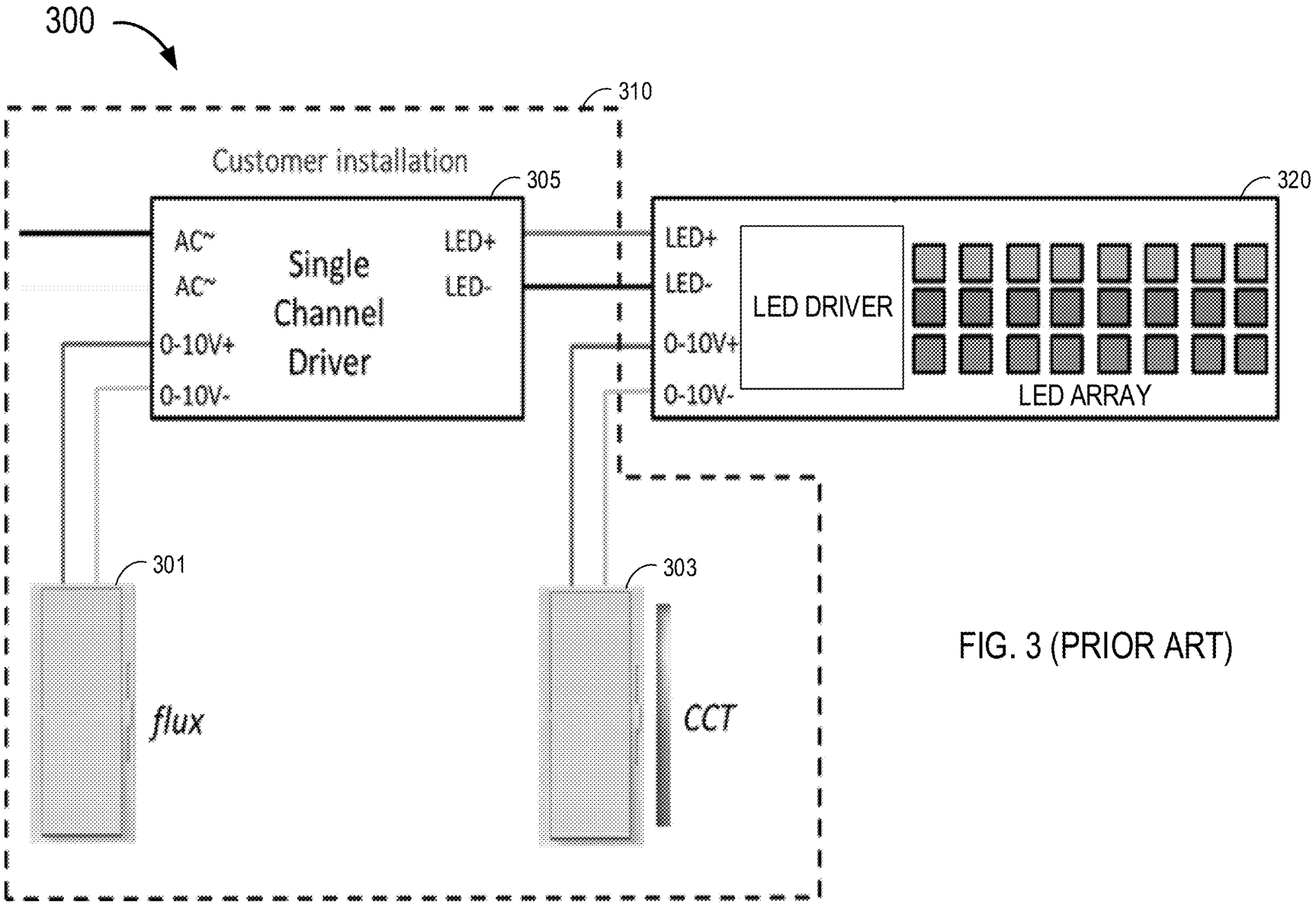
FIG. 3 (PRIOR ART)
FIG. 3 shows a color-tuning device of the prior art requiring a separate flux control-device and a separate CCT control-device.

FIG. 3 shows a color-tuning device 300 of the prior art requiring a separate flux-control device 301 and a separate CCT-control device 303. The flux-control device 301 is coupled to a single-channel driver circuit 305 and the CCT-control device is coupled to a combination LED-driving circuit/LED array 320. The combination LED-driving circuit/LED array 320 may be a current-driver circuit, a PWM driver circuit, or a hybrid current-driver/PWM-driver circuit. Each of the flux-control device 301, the CCT-control device 303, and the single-channel driver circuit 305 is located in a customer facility 310 and all devices must be installed with applicable national and local rules governing high-voltage circuits. The combination LED-driving circuit/LED array 320 is generally located remotely from the customer facility 310. Consequently, both the initial purchase price and the installation price may be significant.

Figure 4:
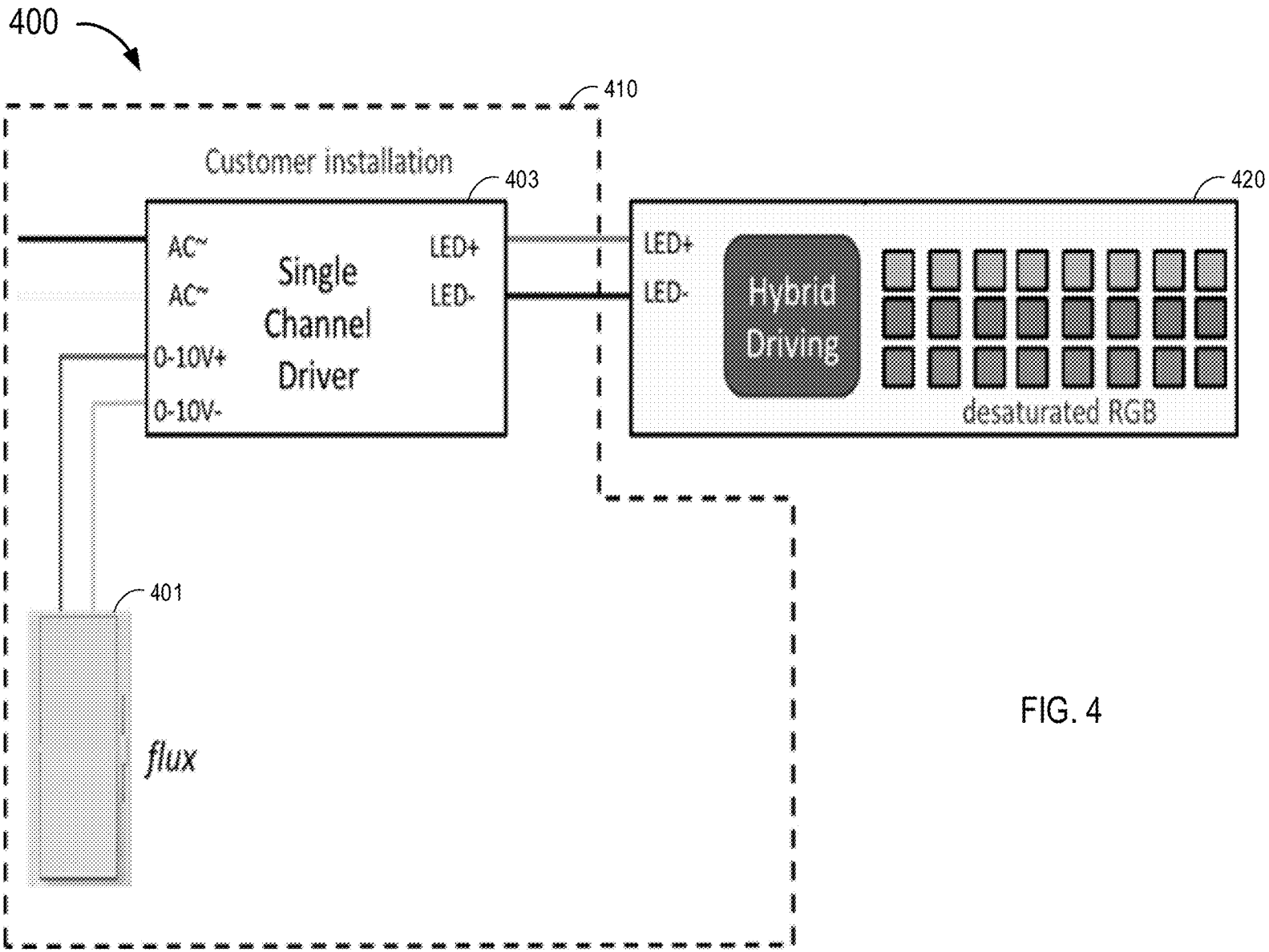
FIG. 4 shows an exemplary embodiment of a color-tuning device using a single control-device, in accordance with various embodiments of the disclosed subject matter.

FIG. 4 shows an exemplary embodiment of a color-tuning device 400 using a single control-device 401, in accordance with various embodiments of the disclosed subject matter. The single control-device 401 is coupled to a single-channel driver circuit 403, both of which are within a customer installation-area 410. The single-channel driver circuit 403 is coupled to a combination hybrid-driving circuit/desaturated LED array 420. The combination hybrid-driving circuit/desaturated LED array 420 is generally located remotely from the customer installation-area 410 (but generally still within a customer facility). One embodiment of the combination hybrid-driving circuit/desaturated LED array 420 is described in detail below with reference to FIGS. 6A and 6B. Significantly, the color-tuning device 400 requires only a single device to control both luminous flux (and luminous intensity) and color temperature as described in more detail below with reference to FIG. 5.

In various embodiments, the single control-device 401 is a variable-resistance device, such as, for example, a slider-type dimmer (a linearly-operated device) or a rotary-type dimmer. In various embodiments, the single control-device 401 comprises a voltage divider. The single control-device 401 provides a continuous, variable output voltage or a discrete set of output voltages. In embodiments, the single control-device 401 may already be in use by the end-user in the customer installation-area 410.

Figure 5:
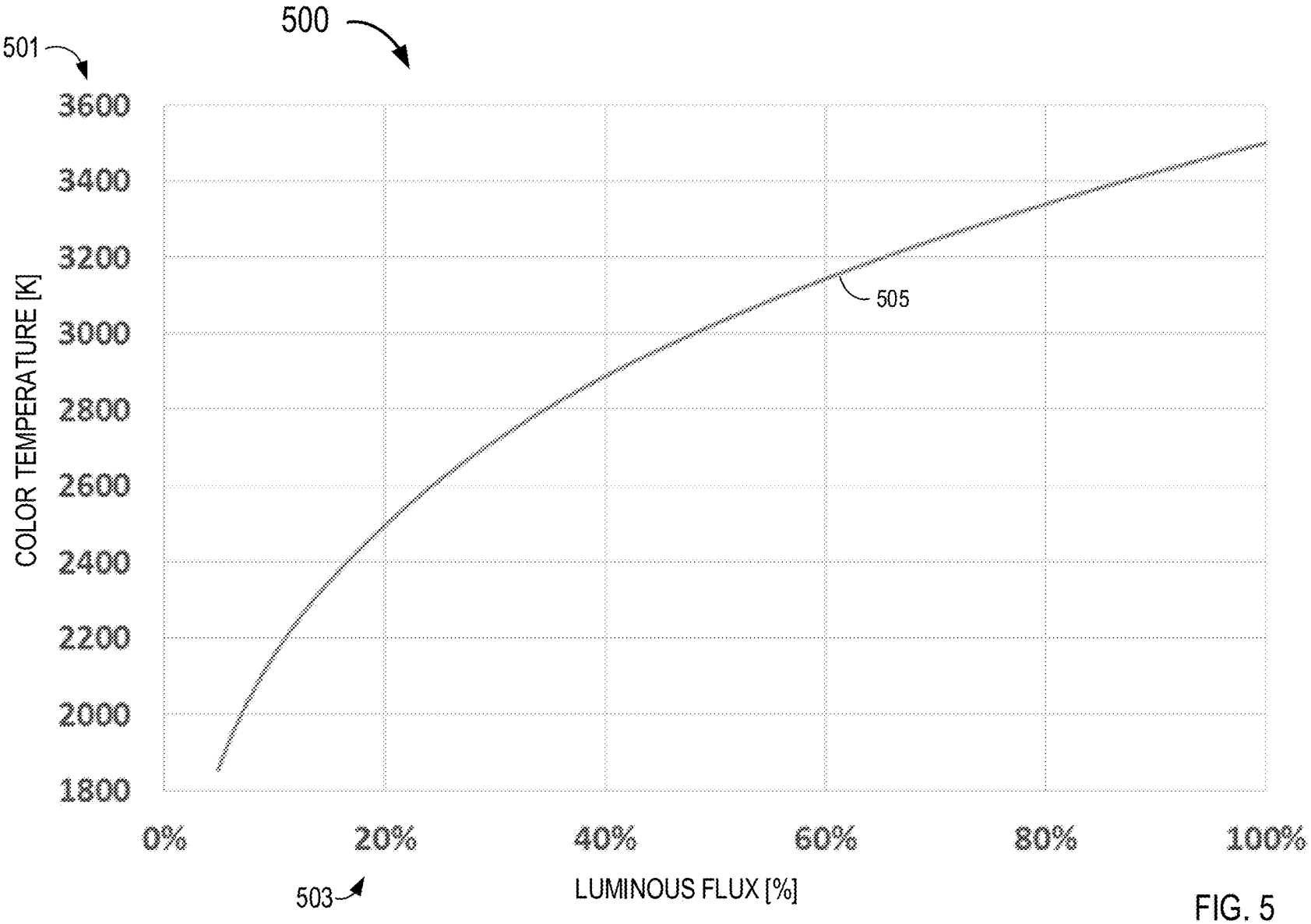
FIG. 5 shows an example of a graph indicating color temperature as a function of luminous flux, in accordance with various embodiments of the disclosed subject matter.

FIG. 5 shows an example of a graph 500 indicating color temperature 501 as a function of luminous flux 503, in accordance with various embodiments of the disclosed subject matter. A curve 505 of the graph 500 indicates that, as the luminous flux 503 increases, a resulting color temperature 501 also increases monotonically with the flux. Consequently, the color temperature of an LED array (see FIG. 6A) increases as an end-user of the system (e.g., see FIG. 4) increases the "brightness" (luminous flux) of the array. Conversely, the color temperature of the LED array decreases as the end-user "dims" the LED array. Consequently, various embodiments of the disclosed subject matter describe a dim-to-warm LED circuit. The dim-to-warm LED circuit also serves to mimic the dim-to-warm behavior of a standard incandescent light bulb—as an end-user dims the incandescent light bulb, the color temperature of the bulb drops commensurately as well.

Figure 6A:
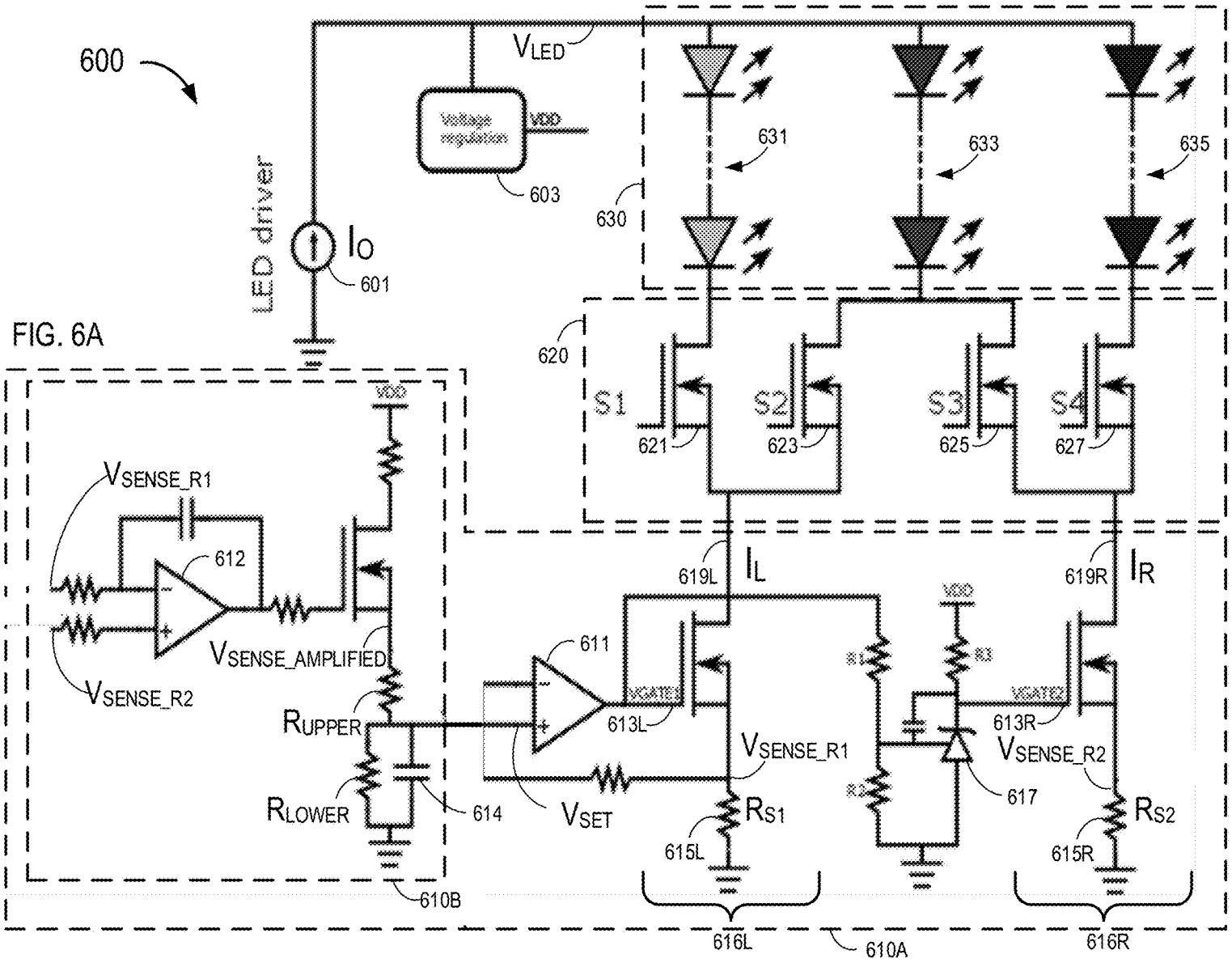
FIG. 6A shows an exemplary embodiment of a color-tuning circuit, in accordance with various exemplary embodiments of the disclosed subject matter.

FIG. 6A illustrates an exemplary embodiment of a hybrid driving-circuit 600 for RGB tuning. The hybrid driving-circuit 600 includes an LED driver 601 electrically coupled to a voltage regulator 603. Together, the LED driver 601 and voltage regulator 603 produce a stabilized current, $I_0$. The hybrid driving-circuit 600 is also shown to include an analog current-division circuit 610A, a multiplexer array 620, and an LED multi-colored array 630.

The LED multi-colored array 630 can include one or any number of a first color of LED arrays 631, one or any number of a second color of LED arrays 633, and one or any number of a third color of LED arrays 635. In various embodiments, more than three colors can be used. Also, the LED arrays 631, 633, 635 can comprise only a single LED in each array.

The LED arrays 631, 633, 635 can be designed to be tuned using the hybrid driving-circuit 600 as described in detail herein. In one embodiment of hybrid driving-circuit 600, the first color of the LED arrays 631 comprises green LEDs, the second color of the LED arrays 633 comprises red LEDs, and the third color of the LED arrays 635 comprises blue LEDs. However, any set of colors may be selected for LED arrays 631, 633, 635. For example, each of the LED arrays 631, 633, 635 may comprise desaturated green LEDs, desaturated red LEDs, and desaturated blue LEDs, respectively, as described above with reference to FIG. 2B. As is recognizable to a person of ordinary skill in the art, the assigning of colors to particular channels is simply a design choice, and while may other designs are contemplated, the current description uses the color combinations discussed immediately above merely to provide for a better understanding of the hybrid driving-circuit 600 described herein.

The hybrid driving-circuit 600 includes the analog current-division circuit 610A that is configured to divide the incoming current, $I_O$, into two currents $I_L$, and $I_R$, as output on a first branch-line 619L (a left-side current-branch 616L of the analog current-division circuit 610A) and a second branch-line 619R (a right-side current-branch 616R of the analog current-division circuit 610A), respectively. In embodiments, the analog current-division circuit 610A may take the form of a driving circuit to provide each of the two branch lines, 619L, 619R with equal currents. In embodiments, the analog current-division circuit 610A may take the form of a driving circuit to provide each of the two branch lines, 619L, 619R with unequal currents.

The analog current-division circuit 610A may further account for any mismatch in forward voltage between different colors of the LEDs while allowing precise control of the drive current in each color. Alternatively, the analog current-division circuit 610A may allow for a deliberate, unequal division of current, which cannot be accomplished by simply switching on various combinations of the LED arrays 631, 633, 635 (the switching portion of the circuitry is described in more detail below with reference to the multiplexer array 620). As is understandable to a person of ordinary skill in the art, other analog current-division circuits may be utilized without departing from the scope of the disclosed subject matter. The analog current-division circuit 610A described herein is provided as one example of a current-divider circuit so the skilled artisan will more fully appreciate the disclosed subject matter.

Additionally, the analog current-division circuit 610A may be mounted on, for example, a printed-circuit board (PCB) to operate with the LED driver 601 and the LED multi-colored array 630. The LED driver 601 may be, for example, a conventional LED driver known in the art. Therefore, the analog current-division circuit 610A can allow the LED driver 601 to be used for applications utilizing two or more of the LED multi-colored array 630. In other embodiments, the analog current-division circuit 610A is mounted on, for example, a PCB that is separate from at least one of the LED driver 601 and the LED multi-colored array 630.

Each current branch of the analog current-division circuit 610A may include a sense resistor (e.g., $R_{S1}$ and $R_{S2}$). For example, in an embodiment with two current channels as shown in FIG. 6A, the analog current-division circuit 610A includes a first sense-resistor 615L ($R_{S1}$) to sense a first voltage, $V_{SENSE_R1}$, of the left-side current-branch 616L and a second sense-resistor 615R ($R_{S2}$) to sense a second voltage, $V_{SENSE_R2}$, of the right-side current-branch 616R. The voltage at $V_{SENSE_R1}$ is produced by the current flowing through the first sense-resistor 615L ($R_{S1}$) and the voltage at $V_{SENSE_R2}$ is produced by the current flowing through the second sense-resistor 615R ($R_{S1}$).

The analog current-division circuit 610A of FIG. 6A is also shown to include a computational device 610B. However, in some embodiments, the computational device 610B may be used in conjunction with or substituted by a microcontroller, as discussed with reference to FIG. 6B, below. The computational device 610B is configured to compare the first sensed-voltage, $V_{SENSE_R1}$, and the second sensed-voltage, $V_{SENSE_R2}$, to determine a set voltage, $V_{SET}$. If the first sensed-voltage, $V_{SENSE_R1}$, is lower than the second sensed-voltage, $V_{SENSE_R2}$, the computational device 610B is configured to increase the set voltage, $V_{SET}$. If the first sensed-voltage, $V_{SENSE_R1}$, is greater than the second sensed-voltage $V_{SENSE_R2}$, the computational device 610B is configured to decrease the set voltage, $V_{SET}$.

In a specific exemplary embodiment, the computational device 610B includes an operational amplifier 612, a capacitor 614 between a location on which the set voltage, $V_{SET}$, is carried, and ground, and a lower resistor, $R_{LOWER}$, (serving as a discharge resistor for the capacitor 614) placed in parallel with the capacitor 614. Additionally, an upper resistor, $R_{UPPER}$, is placed in series with both the resistor $R_{LOWER}$, and the capacitor 614. Benefits of the upper resistor, $R_{UPPER}$, are discussed below.

The first sensed-voltage, $V_{SENSE_R1}$, and the second sensed-voltage, $V_{SENSE_R2}$, are fed to the operational amplifier 612. The computational device 610B may be configured to compare the first sensed-voltage, $V_{SENSE_R1}$, to the second sensed-voltage, $V_{SENSE_R2}$, by subtracting the first sensed-voltage, $V_{SENSE_R1}$, from second sensed-voltage, $V_{SENSE_R2}$. When the operational amplifier 612 is in regulation, the computational device 610B may be configured to convert the difference of the first sensed-voltage, $V_{SENSE_R1}$, and the second sensed-voltage, $V_{SENSE_R2}$, into a charging current. The charging current is used to charge the capacitor 614, thereby increasing the set voltage, $V_{SET}$, when the first sensed-voltage, $V_{SENSE_R1}$, is less than the second sensed-voltage, $V_{SENSE_R2}$. The computational device 610B may be configured to convert the difference of the first sensed-voltage, $V_{SENSE_R1}$, and the second sensed-voltage, $V_{SENSE_R2}$, into the discharging resistor, $R_{LOWER}$. The discharging resistor, $R_{LOWER}$, decreases the set voltage, $V_{SET}$, when the first sensed-voltage, $V_{SENSE_R1}$, is greater than the second sensed-voltage, $V_{SENSE_R2}$.

Therefore, if the first sensed-voltage, $V_{SENSE_R1}$, is higher than the second sensed-voltage, $V_{SENSE_R2}$, the computational device 610B may decrease the set voltage, $V_{SET}$, which in turn decreases the first gate-voltage, $V_{GATE1}$, that supplies power to the left-side current-branch 616L. Consequently, when the operational amplifier 612 is in regulation, the first sensed-voltage, $V_{SENSE_R1}$, is approximately equal to the second sensed-voltage, $V_{SENSE_R2}$. Therefore, during steady state, the ratio of the current of the left-side current-branch 616L to the current of the right-side current-branch 616R is equal to the ratio of the value of the second sense-resistor 615R ($R_{S2}$) to the value of the first sense-resistor 615L ($R_{S1}$).

Consequently, when the value of the first sense-resistor 615L ($R_{S1}$) equals the value of the second sense-resistor 615R ($R_{S2}$), the current flowing through the first sense-resistor 615L ($R_{S1}$) equals the current flowing through the second sense-resistor 615R ($R_{S2}$), the hybrid driving-circuit 600 divides the current into two equal parts (assuming the current drawn by the auxiliary circuits, such as supply voltage generation, is negligible). It should be noted that, as will be appreciated a person of ordinary skill in the art and as discussed above, the computational device 610B shown in FIG. 6A is just one of many possible embodiments.

With continuing reference to FIG. 6A, in various embodiments, the set voltage, $V_{SET}$, is provided to a voltage-controlled current source. The voltage-controlled current source may be implemented with an additional operational amplifier 611. The additional operational amplifier 611 then provides a first gate-voltage, $V_{GATE1}$. The first gate-voltage, $V_{GATE1}$, provides an input to a first transistor 613L that provides a driving current-source $I_L$, on the first branch-line 619L. The first transistor 613L may be, for example, a conventional metal-oxide semiconductor field-effect transistor (MOSFET). In a specific exemplary embodiment, the first transistor 613L may be an n-channel MOSFET. As is recognizable to a skilled artisan, first transistor 613L may be any type of switching device known in the art.

Continuing with this embodiment, a second transistor 613R provides a driving current-source $I_R$, on the second branch-line 619R. As with the first transistor 613L, the second transistor 613R may also comprise a conventional MOSFET or related device type. In a specific exemplary embodiment, the second transistor 613R is an n-channel MOSFET. The second transistor 613R may only be switched on when the left-side current-branch 616L is in regulation. A second gate voltage, $V_{GATE2}$, allows current flow through the second transistor 613R.

The second gate voltage, $V_{GATE2}$, may be fed to a reference (REF) input of a shunt regulator 617. For example, in one exemplary embodiment, the shunt regulator 617 has an internal reference voltage of 2.5 V. When the voltage applied at the REF node of the shunt regulator 617 is greater than 2.5 V, the shunt regulator 617 is configured to sink a large current. When the voltage applied at the REF node of the shunt regulator 617 is less than or equal to about 2.5 V, the shunt regulator 617 may sink a small, quiescent current. As is known to a person of ordinary skill in the art, the of the shunt regulator 617 may comprise a Zener diode.

The large sinking current pulls the gate voltage of the second transistor 613R down to a level below its threshold voltage, which may switch off the second transistor 613R. In some cases, the shunt regulator 617 may not be able to pull the cathode more than the forward voltage, $V_f$, of a diode below the REF node. Accordingly, the second transistor 613R may have a threshold voltage that is higher than 2.5 V. Alternatively, a shunt regulator with a lower internal reference voltage, such as, for example, 1.24 V, may be used.

Benefits of the Resistor $R_{UPPER}$

As described above, and with continuing reference to the computational device 610B shown in FIG. 6A, the upper resistor, $R_{UPPER}$, is placed in series with both the resistor $R_{LOWER}$, and the capacitor 614. In general, the computational device 610B (or the microcontroller described below with reference to FIG. 6B) reacts to a 0 V to 10V analog signal and changes proportions of R/G/B colors of the LED arrays 631, 633, 635 according to an algorithm. In order to make the light change color with the input current, the current needs to be sensed and the signal needs to be rerouted to the 0 V-10 V input.

In hybrid driving-circuits of the prior art, the $V_{SENSE_R1}$ signal is fed to microcontroller or other type of computational device. However, without the resistor $R_{UPPER}$, a trade-off exists in the prior art circuits between the input dynamic range of an internal analog-to-digital converter (ADC) and the power dissipation in the sense resistors, $R_{S1}$ and $R_{S2}$.

The inclusion of the resistor, $R_{UPPER}$, as shown in the hybrid driving-circuit 600 of FIG. 6A improves the aforementioned trade-off between the dynamic range and the power dissipation of the sense resistors. The resistor, $R_{UPPER}$, is inserted between the source terminal of the MOSFET coupled to $V_{SET}$ and the resistor, $R_{LOWER}$, in parallel with the capacitor 614. A combination of the two resistors, $R_{UPPER}$ and $R_{LOWER}$, forms a resistive divider. One original function of this circuit is to make certain that the quantity $V_{SET}$, being equal to $V_{SENSE_R1}$ and $V_{SENSE_R2}$ in equilibrium, is still fulfilled. However, an additional benefit of adding the resistor, $R_{UPPER}$, is that the voltage at $V_{SENSE_AMPLIFIED}$ is now an amplified version of the voltage at $V_{SET}$. The amplification greatly improves the input signal range of the ADC without increasing the power dissipation in the sense resistors, $R_{S1}$ and $R_{S2}$.

For example, the amplification of $V_{SET}$ takes the form of:

$$V_{SENSE_AMPLIFIED} = \left(1 + \frac{R_{UPPER}}{R_{LOWER}}\right) \cdot V_{SET}$$

Consequently, the amplification factor is:

$$\left(1 + \frac{R_{UPPER}}{R_{LOWER}}\right)$$

In a specific exemplary embodiment, presume the target peak-current is 1 ampere (A). $R_{S1}$ and $R_{S2}$ can be selected to each be 0.47 Ohm (Ω), therefore giving a peak voltage of 0.47 V. (Since I×R=V, in this example, 1 A×0.47 Ω=0.47 V). To multiply this voltage, values of $R_{UPPER}$ can be selected to be, for example, 3.3 kΩ, and $R_{LOWER}$ can be selected to be, for example, 2.2 kΩ. Therefore, the amplification factor is (1+3.3 kΩ/2.2 kΩ)=2.5. Consequently, in this example, the value of $V_{SENSE_AMPLIFIED}$=2.5·($V_{SET}$).

These values are provided as examples only so that a person of ordinary skill in the art, upon reading and understanding the information provided herein, will therefore more fully appreciate the disclosed subject matter. A variety of other values may be chosen depending on the specific parameters and expectations for a given circuit.

With continuing reference to FIG. 6A, the hybrid driving-circuit 600 includes the multiplexer array 620 that is configured to electrically couple two of the three LED arrays 631, 633, 635 to the first branch-line 619L and the second branch-line 619R, providing the two current sources $I_L$, $I_R$, created by the analog current-division circuit 610A. In an exemplary embodiment, the multiplexer array 620, includes a number of switching devices, 621, 623, 625, 627. Although four switching devices are shown, the multiplexer array 620 may include more or fewer switches. In a specific exemplary embodiment, the switching devices, 621, 623, 625, 627 comprise MOSFET transistor or similar types of switching devices known in the art. The multiplexer array 620 is configured to conduct currents $I_L$ and $I_R$ into two of the colors of the LED multi-colored array 630 substantially concurrently.

Operationally, the hybrid driving-circuit 600 for RGB tuning uses the analog current-division circuit 610A to drive two colors of the three LED arrays 631, 633, 635 substantially simultaneously. The hybrid driving-circuit 600 then overlays PWM time-slicing with the third (remaining) color of the three LED arrays 631, 633, 635.

In driving the two colors simultaneously, virtual color-points are created. The ratio between the currents $I_L$ and $I_R$ may be pre-determined. For example, the ratio between the currents may be 1:1 or slightly different to maximize efficiency. However, any ratio may be used. Using the three colors of the three LED arrays 631, 633, 635, three virtual color-points can be created (R-G, R-B, G-B), using, for example, the desaturated RGB LEDs described herein. The triangle formed by the three virtual color points (R-G, R-B, G-B) defines the gamut of the hybrid-driving subject matter disclosed herein. In various exemplary embodiments, one or more primary colors R/G/B (a fourth or higher color-point) can be included for mixing.

Figure 6B:
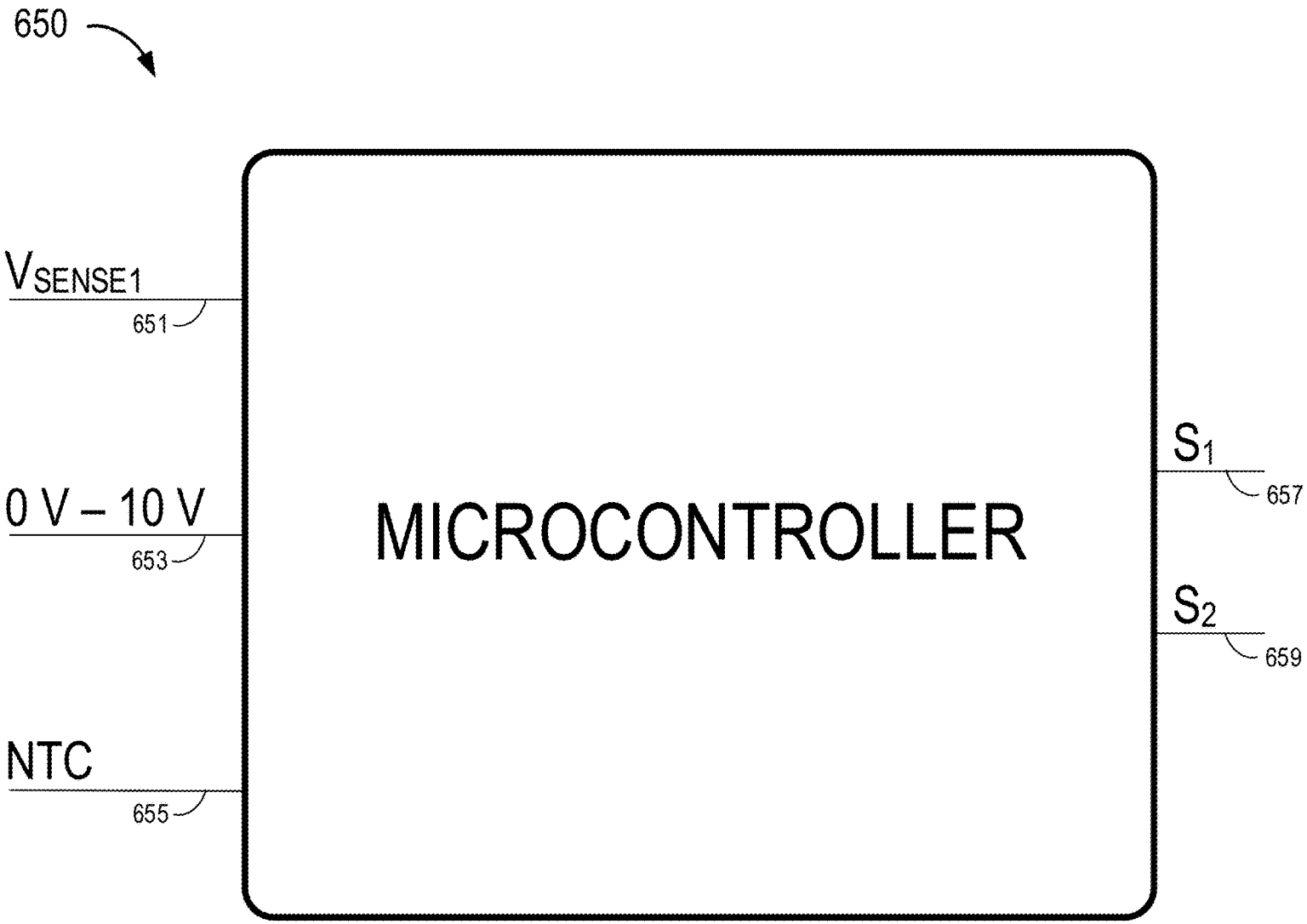
FIG. 6B shows an exemplary embodiment of a micro-controller that may be used with the color-tuning circuit of FIG. 6A.

With reference now to FIG. 6B, a microcontroller 650 that may be used in conjunction with or in place of the computational device 610B. For example, the microcontroller 650 can perform complex signal processing with potentially fewer PCB resources than the analog circuit described above. The skilled artisan will recognize that other types of devices may operate the same as or similarly to the microcontroller 650. A few such device are described below.

In this specific embodiment, the microcontroller 650 receives input signals and can perform the operations of the switching devices 621, 627 of FIG. 6A (the first and fourth switches) the operation of S1 and S4. In embodiments, the microcontroller 650 is configured to monitor the absolute value of the input current by sensing $V_{SENSE_R1}$ at a sense-voltage input 651 and a temperature of the board on which, for example, the microcontroller 650 is located. The temperature is sensed with, for example, a negative temperature-coefficient (NTC) resistor (thermistor, not shown) coupled to an NTC input 655 of the microcontroller 650. These two readings, $V_{SENSE_R1}$ at the sense-voltage input 651 and NTC input 655, can be used to compensate for a potential color shift in the LED arrays 631, 633, 635 due to drive current and temperature. The 0 V to 10 V input can be used as a control input 653. As described herein, the microcontroller 650 can be mapped to a CCT tuning curve. The microcontroller 650 translates incoming instructions (e.g., color temperature as a function of luminous flux, see FIG. 5) to the operation of the multiplexer array 620. Specifically, the microcontroller 650 can provide a first output signal, $I_L$, at a first output 657, to control switch S1 and a second output signal, $I_R$, to control switch S4 at a second output 659.

As described above, the input current is sensed via sense resistor $R_{S1}$ and is converted into a voltage, $V_{SENSE_R1}$. An amplified version of the voltage, $V_{SENSE_AMPLIFIED}$, is fed to the computational device 610B (see FIG. 6A) or to the microcontroller 650 (see FIG. 6B). The microcontroller 650 stores a digitized CCT versus current curve. The digitized CCT versus current curve may be established in a variety of ways known to a skilled artisan and stored in software (e.g., within the microcontroller 650), firmware (e.g., an EEPROM), or hardware (e.g., a Field Programmable Gate Array (FPGA)). The instructions can then select a CCT that corresponds to the sensed current level. In the simplest form, the maximum current can be hard-coded in the microcontroller 650 and correlated with a maximum color temperature (e.g., e.g., 3500 K).

In various embodiments, the computational device 610B and/or the microcontroller 650 can be configured to adjust automatically the CCT versus current curve 500 of FIG. 5 by having, for example, a special calibration mode. For example, the microcontroller 650 can enter the calibration mode if it is power cycled in a special sequence (e.g., a combination of long and short power-up/down cycles). While in this calibration mode, the user (e.g., a calibrating technician at the factory or an advanced end-user) is asked to change the driver-output current between the minimum and maximum levels of the driver output. The microcontroller 650 then stores these two values in, for example, an internal memory (either to the microcontroller 650 or to a board on which the microcontroller 650 is located) as described above. The internal memory can take a number of forms including, for example, electrically erasable programmable read-only memory (EEPROM), phase-change memory (PCM), flash memory, or various other types of non-volatile memory devices known in the art Referring now to FIG. 7, an example of a method 700 to provide a dim-to-warm operation of an LED light source in accordance with various exemplary embodiments of the disclosed subject matter is shown. The method 700 describes using, for example, the hybrid driving-circuit of FIG. 6A for the dim-to-warm operation of the LED multi-colored array 630. The exemplary operations shown enable various ones of the LED multi-colored array 630 to be combined to produce a desired color temperature for a given luminous-signal level from the single control-device of FIG. 4. The luminous-signal level received is read by the single-channel driver circuit 403 (e.g., which may comprise the LED driver 601 of FIG. 6A). The luminous-signal level may then be used to calibrate, for example, the computational device 610B and/or the microcontroller 650 as described above.

Figure 7:
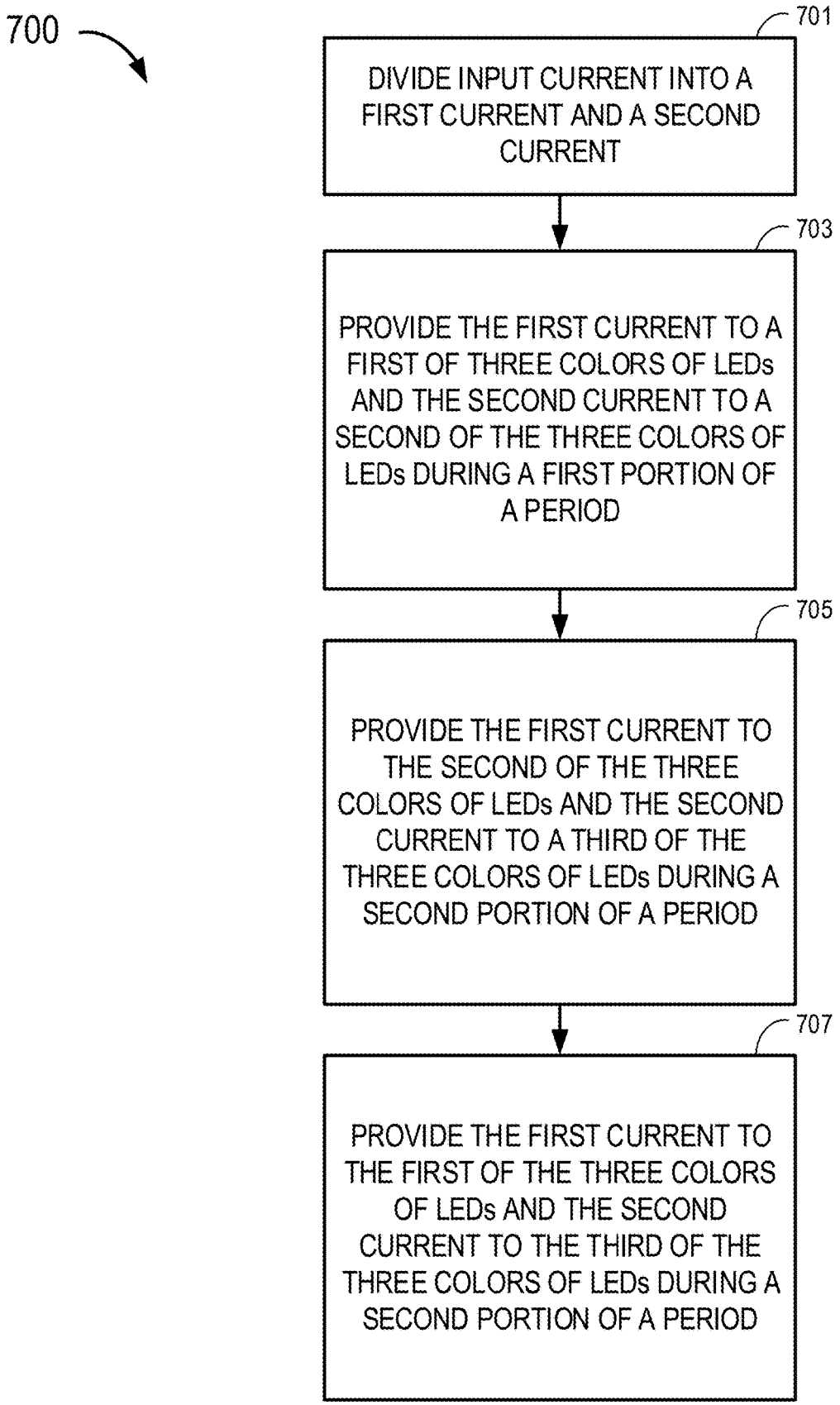
FIG. 7 shows an example of a method to provide a dim-to-warm operation of an LED light source in accordance with various exemplary embodiments of the disclosed subject matter.

With continued reference to FIG. 7, at operation 701, the method 700 divides an input current, via an analog current-division circuit, into a first current, $I_L$, and a second current, $I_R$. At operation 703, the first current is provided to a first of three colors of the LED multi-colored array 630 and the second current to a second of three colors of the LED multi-colored array 630, substantially simultaneously, during a first portion of a period via the multiplexer array 620. At operation 705 the first current is provided to the second of the three colors of the LED multi-colored array 630 and the second current is provided to a third of the three colors of the LED multi-colored array 630, substantially simultaneously, during a second portion of the period via the multiplexer array 620. At operation 707, the first current is provided to the first of the three colors of the LED multi-colored array 630 and the second current is provided to the third of the three colors of the LED multi-colored array 630, substantially simultaneously, during a third portion of the period via the multiplexer array.

In the method 700, the providing of the first current and the second current to different duplets of the LED multi-colored array 630 may occur using pulse-width modulation (PWM) time slicing to provide a drive current to a third of the three colors of the LED multi-colored array 630. In various embodiments, the PWM may be substantially equal between the combination of the first of the three colors of LEDs, the second of the three colors of LEDs, and the third of three colors of LEDs. In various embodiments, the PWM may be different depending on the desired drive characteristics of the LEDs.

Upon reading and understanding the disclosed subject matter, a person of ordinary skill in the art will recognize that the method may be applied to traditional RGB colors of LEDs or to desaturated RGB colors of LEDs. The skilled artisan will also recognize that additional or fewer colors of LEDs can be used.

In various embodiments, many of the components described may comprise one or more modules configured to implement the functions disclosed herein. In some embodiments, the modules may constitute software modules (e.g., code stored on or otherwise embodied in a machine-readable medium or in a transmission medium), hardware modules, or any suitable combination thereof. A "hardware module" is a tangible (e.g., non-transitory) physical component (e.g., a set of one or more microprocessors or other hardware-based devices) capable of performing certain operations and interpreting certain signals. The one or more modules may be configured or arranged in a certain physical manner. In various embodiments, one or more microprocessors or one or more hardware modules thereof may be configured by software (e.g., an application or portion thereof) as a hardware module that operates to perform operations described herein for that module.

In some example embodiments, a hardware module may be implemented, for example, mechanically or electronically, or by any suitable combination thereof. For example, a hardware module may include dedicated circuitry or logic that is permanently configured to perform certain operations. A hardware module may be or include a special-purpose processor, such as a field-programmable gate array (FPGA) or an application specific integrated circuit (ASIC). A hardware module may also include programmable logic or circuitry that is temporarily configured by software to perform certain operations, such as interpretation of the various states and transitions within the finite-state machine. As an example, a hardware module may include software encompassed within a CPU or other programmable processor. It will be appreciated that the decision to implement a hardware module mechanically, electrically, in dedicated and permanently configured circuitry, or in temporarily configured circuitry (e.g., configured by software) may be driven by cost and time considerations.

The description above includes illustrative examples, devices, systems, and methods that embody the disclosed subject matter. In the description, for purposes of explanation, numerous specific details were set forth in order to provide an understanding of various embodiments of the disclosed subject matter. It will be evident, however, to those of ordinary skill in the art that various embodiments of the subject matter may be practiced without these specific details. Further, well-known structures, materials, and techniques have not been shown in detail, so as not to obscure the various illustrated embodiments.

As used herein, the term "or" may be construed in an inclusive or exclusive sense. Further, other embodiments will be understood by a person of ordinary skill in the art upon reading and understanding the disclosure provided. Further, upon reading and understanding the disclosure provided herein, the person of ordinary skill in the art will readily understand that various combinations of the techniques and examples provided herein may all be applied in various combinations.

Although various embodiments are discussed separately, these separate embodiments are not intended to be considered as independent techniques or designs. As indicated above, each of the various portions may be inter-related and each may be used separately or in combination with other types of electrical control-devices, such as dimmers and related devices. Consequently, although various embodiments of methods, operations, and processes have been described, these methods, operations, and processes may be used either separately or in various combinations.

Consequently, many modifications and variations can be made, as will be apparent to a person of ordinary skill in the art upon reading and understanding the disclosure provided herein. Functionally equivalent methods and devices within the scope of the disclosure, in addition to those enumerated herein, will be apparent to the skilled artisan from the foregoing descriptions. Portions and features of some embodiments may be included in, or substituted for, those of others. Such modifications and variations are intended to fall within a scope of the appended claims. Therefore, the present disclosure is to be limited only by the terms of the appended claims, along with the full scope of equivalents to which such claims are entitled. It is also to be understood that the terminology used herein is for the purpose of describing particular embodiments only and is not intended to be limiting.

The Abstract of the Disclosure is provided to allow the reader to quickly ascertain the nature of the technical disclosure. The abstract is submitted with the understanding that it will not be used to interpret or limit the claims. In addition, in the foregoing Detailed Description, it may be seen that various features may be grouped together in a single embodiment for the purpose of streamlining the disclosure. This method of disclosure is not to be interpreted as limiting the claims. Thus, the following claims are hereby incorporated into the Detailed Description, with each claim standing on its own as a separate embodiment.

What is claimed is:

1. A dim-to-warm circuit apparatus, comprising:

a hybrid driving-circuit to be coupled to a light emitting diode (LED) multi-colored array, and to a single control-device, the hybrid driving-circuit to receive an indication of a luminous-signal level from the single control-device and to adjust a color temperature and a corresponding luminous flux of the LED array based on the received luminous-signal level, the hybrid driving-circuit including:

an analog current-division circuit to produce current for at least two LED current-driving sources, the analog current-division circuit further including a resistive divider circuit that is configured to produce an amplified voltage signal; and a multiplexer array coupled between the analog current-division circuit and the LED multi-colored array, the multiplexer array being configured to provide periodically, for a predetermined amount of time, current from at least one of the at least two LED current-driving sources to at least two colors of the LED multi-colored array.

2. The dim-to-warm circuit apparatus of claim 1, further comprising an LED driver electrically coupled to a voltage regulator, the voltage regulator to provide a voltage signal for the LED multi-colored array, a combination of the LED driver and the voltage regulator to provide a stabilized current as an input to the analog current-division circuit.

3. The dim-to-warm circuit apparatus of claim 1, wherein colors of LEDs in the LED multi-colored array include at least one red LED, at least one green LED, and at least one blue LED.

4. The dim-to-warm circuit apparatus of claim 1, wherein the LED multi-colored array comprises at least one desaturated red LED, at least one desaturated green LED, and at least one desaturated blue LED.

5. The dim-to-warm circuit apparatus of claim 1, wherein the multiplexer array comprises at least four switching devices.

6. The dim-to-warm circuit apparatus of claim 1, wherein each of the at least two LED current-driving sources are configured to supply equal amounts of current to the LED multi-colored array.

7. The dim-to-warm circuit apparatus of claim 1, wherein each of the at least two LED current-driving sources are configured to supply unequal amounts of current to the LED multi-colored array.

8. The dim-to-warm circuit apparatus of claim 1, further comprising a voltage-controlled current source configured to supply current to the analog current-division circuit to produce the current for the at least two LED current-driving sources.

9. The dim-to-warm circuit apparatus of claim 8, further comprising a computational device configured to compare a first sensed-voltage, $V_{SENSE_R1}$, and a second sensed-voltage, $V_{SENSE_R2}$, to determine and supply a set voltage, $V_{SET}$, the set voltage being an input voltage for the voltage-controlled current source.

10. The dim-to-warm circuit apparatus of claim 9, wherein the amplified voltage signal, $V_{SENSE_AMPLIFIED}$, is an amplified version of the set voltage, $V_{SET}$.

11. The dim-to-warm circuit apparatus of claim 1, wherein the hybrid driving-circuit is further configured to supply a pulse-width modulation (PWM) time slicing signal to selected ones of the LED multi-colored array.

12. The dim-to-warm circuit apparatus of claim 1, further comprising a microcontroller to map the received luminous-signal level from the single control-device to a correlated color temperature (CCT) to provide an input to set the color temperature of the LED multi-colored array.

13. The dim-to-warm circuit apparatus of claim 1, further comprising a microcontroller configured to store a digitized correlated color temperature (CCT) versus current curve based on the received luminous-signal level from the single control-device, the digitized CCT versus current curve to provide an input to set the color temperature of the LED multi-colored array.

14. The dim-to-warm circuit apparatus of claim 1, wherein the single control-device comprises a voltage divider.

15. A dim-to-warm circuit apparatus, comprising:

a light emitting diode (LED) multi-colored array comprising at least one desaturated red LED, at least one desaturated green LED, and at least one desaturated blue LED; and a hybrid driving-circuit coupled to the LED multi-colored array, the hybrid driving-circuit further to be coupled to a single control-device and being configured to receive a signal from the single control-device that is indicative of a level of luminous flux desired from the LED multi-colored array, the hybrid driving-circuit further being configured to supply a pulse-width modulation (PWM) time slicing signal to selected ones of the LED multi-colored array, the hybrid driving-circuit including:

a computational device configured to determine an amount of current to supply to the LED multi-colored array based on the desired level of luminous flux, the computational device further to correlate a color temperature of the LED multi-colored array with the desired level of luminous flux;

an analog current-division circuit to produce current for at least two LED current-driving sources, the analog current-division circuit further including a resistive divider circuit that is configured to produce an amplified voltage signal; and a multiplexer array having a plurality of switching devices coupled between the analog current-division circuit and the LED multi-colored array and configured to provide periodically, for a predetermined amount of time, current from at least one of the at least two LED current-driving sources to at least one color of the LED multi-colored array.

16. The dim-to-warm circuit apparatus of claim 15, wherein the computational device is a microcontroller configured to map the received luminous-signal level from the single control-device to a correlated color temperature (CCT) to provide an input to the hybrid driving-circuit to set the color temperature of the LED multi-colored array.

17. The dim-to-warm circuit apparatus of claim 15, wherein the computational device is a microcontroller configured to store a digitized correlated color temperature (CCT) versus current curve based on the received luminous-signal level from the single control-device, the digitized CCT versus current curve to provide an input to the hybrid driving-circuit to set the color temperature of the LED multi-colored array.

18. A method, comprising:

determining and supplying a set voltage as an input voltage for a voltage-controlled current source;

amplifying the set voltage using a resistive divider circuit;

determining a luminous flux level desired of a light emitting diode (LED) multi-colored array;

correlating the luminous flux level to a color temperature of the LED multi-colored array;

dividing an input current into a first current and a second current; and based on a determination of the color temperature:

providing the first current to a first of three colors of the LED multi-colored array and providing the second current to a second of three colors of the LED multi-colored array substantially simultaneously during a first portion of a time period;

providing the first current to the second of three colors of the LED multi-colored array and providing the second current to a third of three colors of the LED multi-colored array substantially simultaneously during a second portion of the time period; and providing the first current to the first of three colors of the LED multi-colored array and providing the second current to the third of three colors of the LED multi-colored array substantially simultaneously during a third portion of the period.

19. The method of claim 18, wherein the providing of the first current and the providing of the second current to different duplets of the LED multi-colored array occurs using pulse-width modulation (PWM) time slicing.

20. The method of claim 19, wherein the PWM is substantially equal between a combination of the first of the three colors of the LED multi-colored array, the second of the three colors of the LED multi-colored array, and the third of three colors of the LED multi-colored array.

* * * * *